United States Patent [19]

Nakamura

[11] Patent Number: 4,618,843

[45] Date of Patent: Oct. 21, 1986

[54] ELECTRON BEAM DEFLECTION YOKE

[75] Inventor: Yukio Nakamura, Kanagawa, Japan

[73] Assignee: Sony Corporation, Tokyo, Japan

[21] Appl. No.: 794,732

[22] Filed: Nov. 4, 1985

[30] Foreign Application Priority Data

Nov. 8, 1984 [JP] Japan ..... 59-235451

[51] Int. Cl.[4] ..... H01F 7/00

[52] U.S. Cl. ..... 335/210; 335/212

[58] Field of Search ..... 335/210, 212; 313/421, 313/426, 427, 428, 431

[56] References Cited

U.S. PATENT DOCUMENTS 3,512,023 5/1970 Anthony ..... 335/212 X

*Primary Examiner*—George Harris

*Attorney, Agent, or Firm*—Lewis H. Eslinger; Alvin Sinderbrand

[57] ABSTRACT

A plurality of permanent magnets are usually disposed within a cathode ray tube for correcting the magnetic field causing misconvergence or raster distortion of beams travelling within a cathode ray tube. Since the magnets of plate shape are magnetized in the thickness direction thereof being reversed at both the ends thereof along the longitudinal direction thereof, it is possible to effectively distribute magnetic field generated by the permanent magnets within the cathode ray tube without increasing the thickness of the magnets.

5 Claims, 5 Drawing Figures

ELECTRON BEAM DEFLECTION YOKE

BACKGROUND OF THE INVENTION

1. Field of the Invention

The present invention relates generally to an electron beam deflection yoke provided with electromagnets or coils for deflecting electron beams generated in a cathode ray tube, and more specifically to magnetic field correcting permanent magnets arranged within a ferrite core for an-inline color cathode ray tube.

2. Description of the Prior Art

In a color cathode ray tube used with a color television picture device, there have conventionally been known various methods of incorporating permanent magnets in a deflection yoke in order to correct magnetic field, that is, beam misconvergence or raster distortion. In deflection of electron beams within a cathode ray tube, the deflection effect upon the electron beams depends upon a resultant magnetic field of a magnetic field generated by horizontal and vertical deflecting coils wound around a magnetic deflection yoke and a magnetic field generated by the above-mentioned magnetic field correcting magnet. Therefore, in the case where permanent magnets are used for correcting the magnetic field which may causes the raster distortion, beam spot distrotion or beam misconvergence, the permanent magnets are usually disposed within the deflection yoke in an appropriate space formed between the horizontal deflecting coil and the vertical deflecting coil, for instance. As an example, Japanese Published Unexamined Patent Application No. 57-121136 discloses a method of fixing magnetic field correcting magnets within the deflection yoke, in which the magnet plate is magnetized so that a pair of North and South poles are formed at both the ends thereof along the longitudinal direction thereof as designated by numeral 10 in FIG. 1.

By the way, in the case where the magnets 10 are fixed within the deflecting yoke, it is indispensable to prepare within the deflecting yoke a space in which the magnets are disposed, and further it is peferable to prepare the space as small as possible, because the space will exert a harmful influence upon the deflection efficiency of the horizontal and vertical deflecting coils.

In the prior-art magnetic field correcting permanent magnet, however, since the magnets are magnetized as explained with reference to FIG. 1, when the thickness of the magnet 10 is reduced to decrease the space within the magnetic yoke, the magnetic field generated by the magnets is inevitably weakened, thus resulting in a problem in that it is impossible to sufficiently correct the beam misconvergence or the raster distortion.

SUMMARY OF THE INVENTION

With these problems in mind, therefore, it is the primary object of the present invention to provide an electron beam deflection yoke used for a color cathode ray tube having a plurality of in-line arranged electron guns, by which it is possible to effectively correct magnetic field within the tube which may cause beam misconvergence or raster distortion, while allowing the thickness of the permanent magnet to be as thin as possible without exerting a harmful influence upon the deflection efficiency of the horizontal and vertical deflecting coils.

To achieve the above-mentioned object, the electron beam deflection yoke used for a color cathode ray tube in which a plurality of electron guns are arranged in-line fashion according to the present invention comprises: (1) a magnetic core; (2) a horizontal deflecting coil for generating a horizontally deflecting magnetic field; (3) a vertical deflecting coil for generating a vertically deflecting magnetic field; (4) separator means for separating said two horizontal and vertical deflecting coils; and, in particular, (5) a plurality of magnetic field correcting magnets of plate shape disposed on said separator means, said magnets being magnetized in such way that a pair of magnetic poles are formed near both ends of said plate-shaped magnet respectively in a thickness direction thereof and further one magnetic polarity formed near one end thereof is opposite to the other magnetic polarity formed near the other end thereof along a longitudinal direction thereof.

In the arrangement of the permanent magnets as described above, since two pairs of mutually different magnetic poles are formed in the thickness direction of the magnet being reversed at both the ends thereof in the longitudinal direction, when the magnets are arranged along the outer circumference of the separator means, the intensity of the magnetic field generated by one magnet is further strengthened by the magnetic field generated by the other two adjacent magnets, in particular, within the circular separator means, thus it being possible to effectively correct the magnetic field within the cathode ray tube, that is, the electron beams travelling within the tube, as compared with the prior art permanent magnets. Further, according to the present invention, since it is not necessary to increase the thickness of the magnet, it is possible to reduce the radial dimension of the space for receiving the permanent magnets between the separator and the magnetic yoke (ferrite core) within the cathode ray tube.

BRIEF DESCRIPTION OF THE DRAWINGS

The features and advantages of the electron beam deflection yoke according to the present invention will be more clearly appreciated from the following description of the preferred embodiments of the invention taken in conjunction with the accompanying drawings in which like reference numerals designate the same or similar elements throughout the figures thereof and in which.

DETAILED DESCRIPTION OF THE PREFERRED EMBODIMENTS

Figure 1:
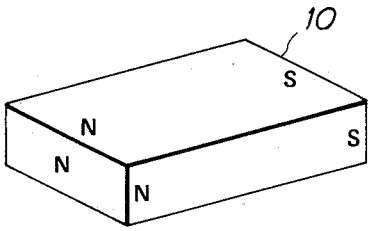
FIG. 1 (PRIOR ART)
FIG. 1 is a perspective view of a permanent magnet used with a prior-art electron beam deflection yoke, in which the magnet is simply magnetized so as to form a single pair of magnetic poles along the longitudinal direction thereof.
Figure 2:
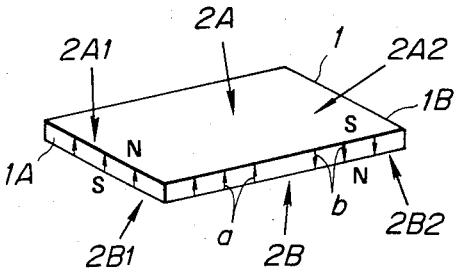
FIG. 2 is a perspective view of a permanent magnet used with the electron beam deflection yoke according to the present invention, in which the magnet is magnetized so as to form two pairs of mutually different magnetic poles in the thickness direction thereof being reversed at both the ends thereof in the longitudinal direction thereof.
Figure 3:
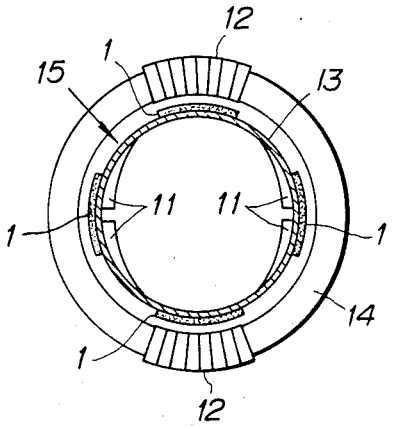
FIG. 3 is a cross-sectional view, partly in front view, of the deflection yoke according to the present invention for assistance in explaining the elements arranged within the deflection yoke.
Figure 4:
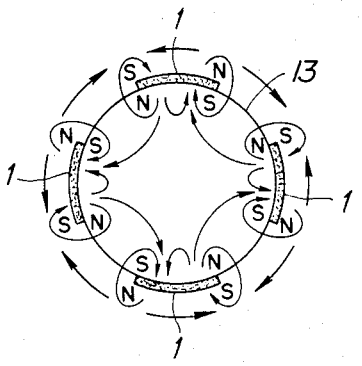
FIG. 4 is a diagrammatical view showing the magnetic field distribution of the permanent magnets used with the electron beam deflection yoke according to the present invention.

With reference to FIGS. 2 to 4, one embodiment of the electron beam deflection yoke according to the present invention will be described hereinbelow. FIG. 1 shows a permanent magnet for correcting beam misconvergence or raster distortion within a colar cathode ray tube, which is incorporated in the deflection yoke according to the present invention.

The magnet 1 is of thin plate type and is made up of a magnetic rubber material so as to be bendable. The magnet has a first surface 2A and a second surface 2B. A North pole N is magnetized near one end 2A1 of the first surface 2A and a South pole S is magnetized on the same one end 2B1 of the second surface 2B so as to form a pair of magnetic poles, that is, a magnetic polarity in the thickness direction of the magnet plate. Similarly, a South pole S is magnetized near the other end 2A2 of the first surface 2A and a North pole N is magnetized on the same other end 2B2 of the second surface 2B so as to form another pair of magnetic poles, that is, another magnetic polarity in thickness direction thereof. Therefore, the magnetic polarity (N and S) formed near one end 2A1 or 2B1 of the magnet 1 is opposite to that (S and N) formed near the other end 2A1 or 2B2 thereof along the longitudinal direction of the magnetic plate. Therefore, the magnetic flux within the magnet 1 is distributed in the upward direction near one end 2A1 or 2B1 of the magnet 1 as shown by the arrow a but in the downward direction near the other end 2A2 or 2B2 thereof as shown by the arrow b in FIG. 2.

The permanent magnets 1 magnetized as described above are stuck onto the outer circumference of a separator 13 disposed between horizontal deflecting coils 11 and vertical deflecting coils 12, as shown in FIG. 3. The horizontal deflecting coils 11 are wound into a saddle shape along the inner circumference of the separator 13 radially symmetrically, the vertical deflecting coils 12 are directly wound into a toroidal shape around a magnetic core 14 made of ferrite also radially symmetrically. Here, the magnetic core 14 is fixed outside the separator 13 with an appropriate holding member (not shown) so as to provide a small gap 15 between the separator 13 and the magnetic core 14. That is, the permanent magnets 1 are stuck onto the separator 13 so as to be disposed within this space 15.

In the embodiment shown in FIG. 3, four magnets 1 are arranged as follows: a pair of magnets 1 are disposed on the outsides of the two horizontal deflecting coils 11 so as to face to each other at diametrically opposite positions and further another pair of magnets 1 are disposed on the inside of the two vertical deflecting coils 12 so as to face to each other at diametrically opposite positions. The arrangement of magnetic poles or the magnetic polarities formed by four magnets 1 along the outer circumference of the separator 13 is such as shown in FIG. 4. That is, the direction of the magnetic polarities near the end of the magnet 1 is diametrically reversed alternately in sequence along the outer circumference of the separator 13. As depicted in FIG. 4, since each magnet 1 is slightly curved, each magnetic field produced by each magnet 1 is effectively and mutually intensified by each adjacent magnet 1, in particular, within the separator 13, that is, within the space in which beams of the cathode ray tube travel. In other words, part of the magnetic field produced between two magnetic poles formed at both the ends of the magnet 1 and distributed along the outer surface of each magnet (distributed outside the separator) when the magnet is placed flat is effectively distributed between the two magnetic poles formed at the same end of each magnet 1 and along the thickness direction of the magnet (distributed radially to the separator) when the magnet is bent.

Therefore, it is possible to enhance the availability of the magnetic flux generated by the magnets 1 as compared with the conventional magnet 10 magnetized as shown in FIG. 1. In the case of the conventional magnet 10, almost half of the magnetic flux produced between the two magnetic poles is distributed on the outside of the separator 13, without being effectively utilized for correcting the beam misconvergence or the raster distortion.

On the other hand, in the magnet 1 according to the present invention, since the magnet 1 is magnetized as shown in FIG. 2 and further the magnets 1 are arranged along the circular separator 13 as shown in FIG. 4, it is possible to generate a sufficiently strong magnetic field while decreasing the thickness of the magnet 1, in the case where the magnet 1 is made of a material having a great coercive force such as ferrite. This causes such advantages that it is possible to reduce the radial dimension of the gap 15 between the separator 13 and the magnetic core 14.

Figure 5:
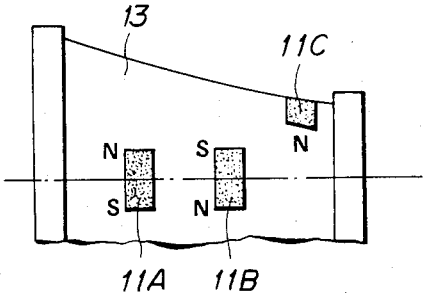
FIG. 5 is a diagrammatical side view showing a part of the separator used with another embodiment of the electron beam deflection yoke according to the present invention.

The above embodiment has been described of the arrangement such that the plural magnets are disposed along the circumferential direction of the separator 13 or along the outer circumference of the cathode ray tube. However, it is also possible to arrange the plural magnets along the axial direction of the cathode ray tube or along the direction from the picture surface side to the tube back side as shown in FIG. 5. In FIG. 5, three magnets 11A, 11B and 11C are arranged in sequence in such a way that the magnetic pole of each magnet is alternately reversed. In the in-line color cathode ray tube, since three beam of R, G and B signals travel through each magnet 11A to 11C in an in-line state (three beams are arranged on a line), the magnets 11A and 11B arranged at the front side of the tube have an effect of correcting the misconvergence of the side beams of the R and B signals, while the magnet 11C arranged at the back side of the tube has an effect of correcting the misconvergence of the center beam of the G signal.

In the case where the magnets 1 are arranged as shown in FIG. 5, the plural magnets are slightly curved inside along the separator 13 in the axial direction of the tube, it is possible to obtain the similar effect as explained with reference to FIG. 4. Therefore, it is also possible to effectively distribute the magnetic field within the separator 13 for effectively correcting the beam misconvergence or the raster distortion within the cathode ray tube, as compared with the conventional magnet 10 magnetized as shown in FIG. 1.

As described above, since the permanent magnets for correcting the misconvergence or the raster distortion of the beams travelling within an in-line color cathode ray tube according to the present invention is magnetized in the thickness direction thereof being reversed at both the ends thereof along the longitudinal direction thereof, it is possible to enhance the above-mentioned effect of correcting the magnetic field which may cause beam misconvergence or raster distortion within a color cathode ray tube, without increasing the space occupied by the magnets to be arranged within the deflection yoke.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. An electron beam deflection yoke used for a color cathode ray tube in which a plurality of electron guns are arranged in-line fashion, which comprises of:

(a) a magnetic core;

(b) a horizontal deflecting coil for generating a horizontally deflecting magnetic field;

(c) a vertical deflecting coil for generating a vertically deflecting magnetic field;

(d) separator means for separating said two horizontal and vertical deflecting coils; and (e) a plurality of magnetic field correcting magnets of plate shape disposed onto said separator means, said magnets being magnetized in such a way that a pair of magnetic poles are formed near both ends of said plate-shaped magnet, respectively, in a thickness direction thereof and further one magnetic polarity formed near one end thereof is opposite to the other magnetic polarity formed near the other end thereof along a longitudinal direction thereof.

2. The electron beam deflection yoke as set forth in claim 1, wherein said magnetic field correcting magnets are magnetized rubber magnets.

3. The electron beam deflection yoke as set forth in claim 1, wherein said magnetic field correcting magnets are arranged so as to correct beam misconvergence.

4. The electron beam deflection yoke as set forth in claim 1, wherein said magnetic field correcting magnets are arranged so as to correct raster distortion.

5. The electron beam deflection yoke as set forth in claim 4, wherein said four magnetic field correcting magnets are disposed on horizontal and vertical axes of said circular separator means so as to form eight magnetic poles.

* * * * *